United States Patent [19]

Vogler et al.

[11] Patent Number: 5,060,252

[45] Date of Patent: Oct. 22, 1991

[54] GENERATOR FOR OPERATING A ROTATING ANODE X-RAY TUBE

[75] Inventors: Gerd Vogler, Minden; Wulf Muller, Norderstedt, both of Fed. Rep. of Germany

[73] Assignee: U.S. Philips Corporation, New York, N.Y.

[21] Appl. No.: 532,041

[22] Filed: May 31, 1990

[30] Foreign Application Priority Data

Jun. 3, 1989 [DE] Fed. Rep. of Germany ..... 3918164

[51] Int. Cl.[5] ..... H05G 1/66; H05G 1/10

[52] U.S. Cl. ..... 318/93; 378/101; 378/144

[58] Field of Search ..... 378/110–112, 378/93, 94, 102–104, 101, 144

[56] References Cited

U.S. PATENT DOCUMENTS

| | | | |
|---|---|---|---|
| 4,082,954 | 4/1978 | Franke | 378/101 |
| 4,107,535 | 8/1978 | Kotabe et al. | 378/93 |
| 4,221,968 | 9/1980 | Franke | 378/101 |
| 4,553,255 | 11/1985 | Kanerva | 378/112 |
| 4,641,330 | 2/1987 | Herwig et al. | 378/101 |
| 4,653,082 | 3/1987 | Tsuchiya | 378/101 |
| 4,720,844 | 1/1988 | Bougle | 378/101 |
| 4,742,535 | 5/1988 | Hino et al. | 378/110 |
| 4,969,171 | 11/1990 | Yamada et al. | 378/101 |

*Primary Examiner*—Edward P. Westin
*Assistant Examiner*—Kim-Kwok Chu
*Attorney, Agent, or Firm*—William Squire

[57] ABSTRACT

A power generator drives a rotating anode of an X-ray tube via a stator-rotor in which the stator receives the anode side high voltage potential. An isolating transformer is connected to an alternating current source which converts DC voltage to AC voltage via a rectifier bridge, a regulator and a switching inverter. The secondary winding of the isolating transformer is coupled to a second rectifier bridge for applying rectified voltage to a second switching inverter that generates the alternating currents for the stator windings. The second inverter receives the high voltage which is also applied to the tube to generate X-rays.

13 Claims, 1 Drawing Sheet

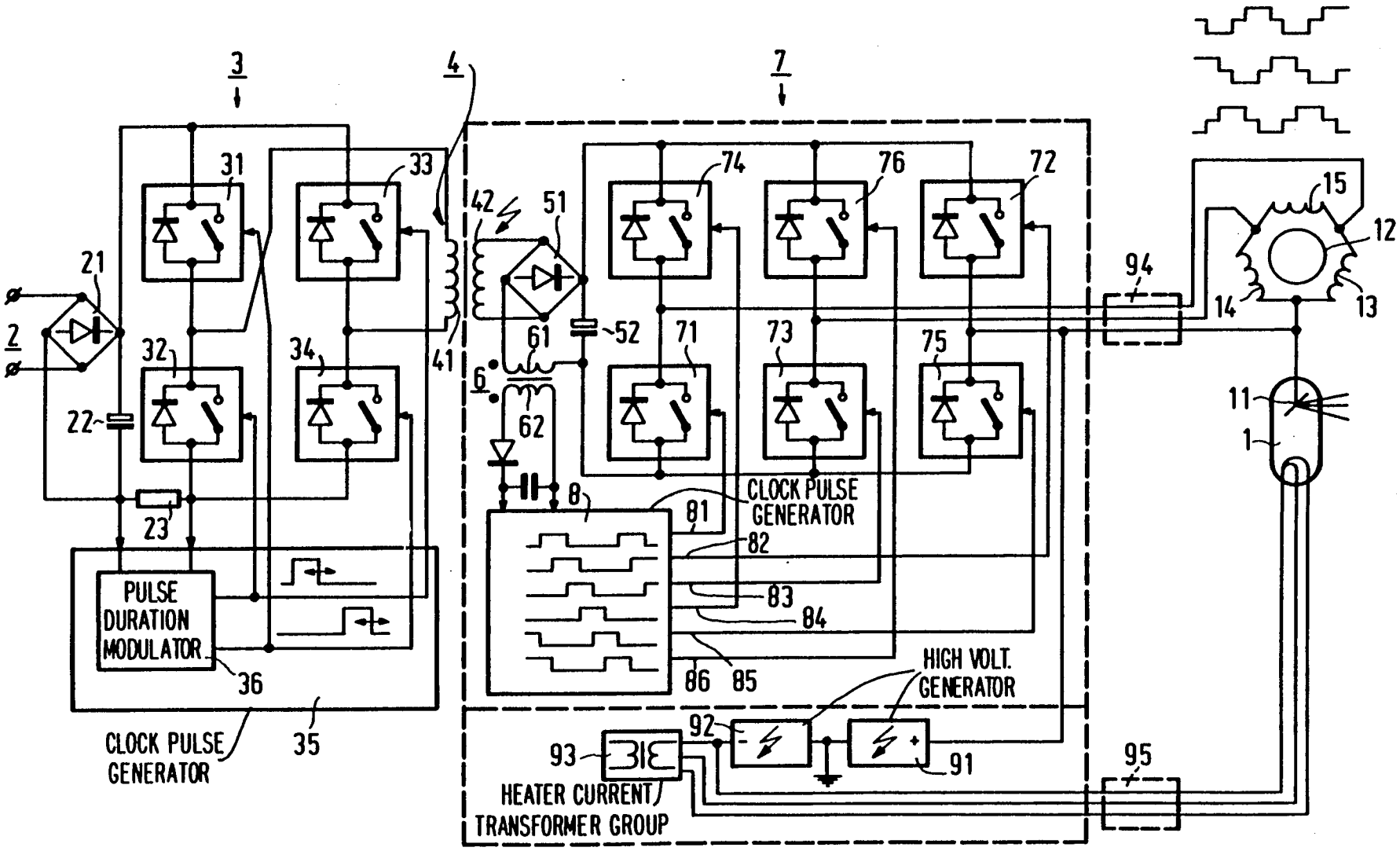
CLOCK PULSE GENERATOR
HIGH VOLT. GENERATOR
HEATER CURRENT TRANSFORMER GROUP
PULSE DURATION MODULATOR
CLOCK PULSE GENERATOR

GENERATOR FOR OPERATING A ROTATING ANODE X-RAY TUBE

The invention concerns a generator for operating a rotating anode X-ray tube whose rotating anode is connected to a rotor that cooperates with a stator whose windings are coupled to a high-voltage generator delivering the high-voltage for the rotating anode and the rotor. A generator of the type mentioned at the beginning is known as prior art from U.S. Patent Specification 4,107,535. When the stator windings or the stator are at the same high-voltage potential as the rotor, the "air" gap between rotor and stator can be substantially smaller than with conventional X-ray tubes, in which the rotor conducts high-voltage potential and the stator is connected to earth; a small gap results in a substantially better drive efficiency. A disadvantage in this regard is that a multiphase isolating transformer, which must be designed for the anode-side high voltage (e.g. 75 kV) and a low frequency (e.g. 50 or 150 Hz), which is matched to the desired rotational speed, is required to generate the currents for the stator windings. Such an isolating transformer is relatively bulky and expensive.

It is an object of the present invention to configure a generator of the type mentioned at the beginning in such a way that the expense for the isolating transformer can be reduced.

This object is achieved according to the invention in that an isolating transformer that can be connected with its primary winding to an alternating-voltage source is provided, in that the secondary winding of the isolating transformer is coupled to a rectifier for feeding an inverter that generates the alternating currents for the stator windings from the rectified voltage, and in that the inverter is ohmically connected to the high-voltage generator.

Thus, whereas in the known arrangement the stator currents must be transferred with a high reactive component via a multi-phase isolating transformer, in the case of the invention only the effective power for feeding an inverter, which delivers the stator currents, is transferred via the (single-phase) isolating transformer. An inverter is required, in any case, when the frequency of the stator currents deviates from the mains frequency. In the invention, this inverter is operated on the anode-side high-voltage potential.

A preferred further development of the invention provides that the frequency of the alternating voltage that is supplied to the primary winding by the alternating-voltage source is substantially higher than the frequency of the currents delivered by the inverter. Consequently, when the frequency of the alternating-voltage source lies between, for example, a few kHz and a few hundred kHz, the overall volume of the isolating transformer can be substantially reduced. This isolating transformer can then contain a cost-effective ferrite core, and an encapsulated secondary coil, and is only slightly larger than a line transformer for a television receiver, which is similar in design.

A further embodiment provides that the alternating-voltage source includes a switching device for generating alternating-voltage pulses from the direct current voltage delivered by a direct current voltage source. Such alternating-voltage sources can be produced in an especially cost-effective way.

In yet another embodiment of the invention, a regulating circuit is provided for stabilizing the current drawn from the direct-voltage source. As a result, the direct current delivered by the direct current voltage source is stabilized, as a result of which the stator currents delivered by the inverter are also stabilized. They are therefore independent of fluctuations in mains voltage and of changes in resistance of the stator windings.

In a further embodiment of the invention the stator currents and the high-voltage for the rotating anode X-ray tube are transferred jointly via a multi-core high-voltage cable. Whereas, in addition to the two high-voltage cables for supplying the high-voltages for anode or cathode, X-ray tube assemblies with rotating anode X-ray tube, in which the rotor conducts high-voltage potential and the stator - on average over the time - reference potential in the normal way, further require a stator cable over which the stator currents are supplied, this cable can be eliminated in this embodiment of the invention. The stator currents are then supplied via a multi-core high-voltage cable. In the case of three stator windings, this cable must have three cores. However, high-voltage cables for X-ray tubes possess three cores from the very start in order to be able to feed two heating filaments on the cathode side.

The invention is explained below with reference to the drawing, which shows a schematic block diagram of a generator according to the invention.

The drawing shows a rotating anode X-ray tube 1, whose rotating anode 11, which is indicated only diagrammatically, is connected to a rotor 12 (actually arranged inside the tube bulb). The rotor 12 is driven by three windings 13, 14 and 15 of a stator, which are connected in the triangle and are offset spatially by 120 with respect to one another (and are arranged outside the tube bulb), the gap remaining between rotor and stator being small, thus resulting in a good drive efficiency.

The electrical energy for the drive of the rotating anode is supplied at the mains terminals 2 to a rectifier bridge 21 whose output voltage is smoothed by a capacitor 22; however, it is also possible to employ a three-phase system with a six-diode rectifier bridge construction for feeding. The capacitor voltage is supplied via a resistor 23 to a circuit 3 which converts the direct current voltage into alternating current voltage pulses of sufficiently high frequency, for example 20 kHz, and thus feeds the primary winding 41 of an isolating transformer 4 which is connected to its the output of circuit. The circuit 3 possesses two parallel branches, each having two series connected switch combinations 31, 32 or 33, 34. Each switch combination comprises the parallel connection of a diode operated in the reverse direction and a controllable semiconductor switch. The primary winding 41 has one terminal is connected between the tie points of the series switch combinations 31, 32 and a second terminal connected between the tie point of the series switch combination 33, 34.

The switch combinations are controlled by a clock pulse generator 35 with a clock frequency which corresponds to the transfer frequency of the isolating transformer 4, that is to say with 20 kHz in the example. The control of the switch combination or of the controllable switches contained therein by the clock pulse generator 35 takes place in push-pull, so that in one phase an alternating current flows via the switch combination 31, the winding 41 and the switch combination 34, and in the other phase via the switch combination 32, the primary winding 41 (in the opposite direction from in the preceding switching phase), and the switch combination 33.

The isolating transformer 4 isolates the low-voltage potential at its primary winding from the anode-side high-voltage potential at its secondary winding. Because of the relatively high frequency with which the isolating transformer is operated (20 kHz), it can include an inexpensive ferrite core of small cross-section whose secondary winding is encapsulated for insulating purposes.

The alternating voltage at the secondary winding 42 is rectified by a rectifier bridge 51 in conjunction with a capacitor 52 which is connected in series to the primary winding 61 of a transformer 6 at the output of the rectifier bridge 41. The switching device 3, the isolating transformer 4, the rectifier bridge 51, the capacitor 52 and the primary winding 61 of the transformer 6, which acts as storage choke, form a switched-mode power supply of the parallel push-pull transformer type. This switched-mode power supply permits the direct voltage at the capacitor 22 to be converted with a good degree of efficiency into a direct voltage at the capacitor 52, the terminals of the capacitor 22 approximately conducting at reference potential, while those of the capacitor 52 approximately conduct high-voltage potential as as will be set forth in more detail.

The voltage at the capacitor 52 is supplied to an inverter 7, which delivers the currents for the three stator windings 13, 14 and 15. The inverter 7 is a three-phase inverter with three branches connected in parallel to the capacitor 52, which branches consist of the series connection of, in each case, two switch combinations 71, 74; 73, 76, 75, 72. The three tie points between the switch combinations in the three branches are connected to three terminals of the stator windings 13 . . . 15, which are connected in the triangle, via one line each.

The switch combinations 71 . . . 76 can have the same construction as the switch combination 31 . . . 34, it being possible for the controlled switches to be formed in each case by a bipolar transistor, a MOSFET or a GTO thyristor, or combinations thereof. By contrast, normal thyristors, which do not block until after a current zero, are unsuitable as switches.

The switch combinations 71..76 are controlled by a clock pulse generator 8 in such a way that the switch combinations 74, 76, 72 or 71, 73, 75 located in the respective upper and lower part of the branches become conducting one after another, the switch combinations which are not located in the same branch simultaneously becoming conducting one after another in the respective other part. For example, during the first half of the time during which the switch 71 in the lower left-hand branch is conducting, the switch 72 in the upper right-hand branch is conducting, and during the second half it is the switch 76 in the central branch of the upper part. For this purpose, the clock pulse generator 8 delivers at its outputs 81 . . . 86, which are connected to the switch combinations 71 . . . 76, six clock pulses with a frequency of 150 Hz, the potentials on the control lines 82, 84 and 86 of the three upper switches 72, 74 and 76 being staggered by a suitable amount with respect to the potentials on the control lines 81, 83 and 85 for the lower switches 71, 73 and 75. As is indicated diagrammatically, the clock pulses at the sequential outputs 81 . . . 86 are each offset by 60° with respect to one another, rendering the switches connected therewith conducting during a third of each period. Consequently, at the three inputs of the stator windings the result is stair-step voltages of 150 Hz with the mutually staggered profile indicated above these windings.

The six mutually phase-staggered clock pulses can be derived in the clock pulse generator 8, for example from an oscillator with the six-fold clock frequency (at 900 Hz) in conjunction with a binary counter whose outputs are combined via logic gates so that the phase-staggered clock pulses result; the oscillator, the binary counter and the logic gates are not represented in more detail in the drawing. The supply voltage for the clock pulse generator 8 is generated by rectification of the output voltage of the secondary winding 62 of the transformer 6. The primary winding 61 of this transformer is coupled to the output of the rectifier bridge 51, so that a direct current flows through it, but a transferrable alternating voltage results due to the fact that the rectifier bridge 51 delivers voltage only periodically and acts in the intervals as a free-wheeling diode in accordance with the switched-mode regulator principle. Thus, direct current flows through the winding 61 to recharge the capacitor 52, with a triangular superimposed alternating-current component. The primary winding 61 of the transformer 6 thus has a double function, serving as storage choke in the switched-mode mode power supply 3, 4 etc. on the one hand, and forming the primary winding of the transformer 6, which transfers the alternating-current components, for generating a supply voltage for the clock generator 8, on the other hand.

One of the three lines which connect the tie points in the three branches to the three stator terminals is connected to the output of a high-voltage generator 91. This high-voltage generator delivers the high voltage (positive with respect to a reference potential) (ground) for the rotating anode, which is supplied to the latter via the abovementioned line. Consequently, the inverter 7 with connection of the clock pulse generator 8 and of the secondary winding 42 is also connected to high voltage.

The negative high voltage is generated by a high-voltage generator 92. The output of the high-voltage generator 92 is connected to one of the three output lines of the heater current transformer group 93, which delivers the currents for the two heating filaments of the X-ray tube. The high voltage for the anode or the cathode, and the stator currents or the heating filament currents are transferred to the X-ray tube assembly via in each case one high-voltage cable 94 or 95 indicated diagrammatically in the drawing. Whereas in conventional X-ray tube assemblies having a stator operated at reference potential, a stator cable, via which the stator currents flow, is still always required to drive the rotating anode, such a cable can be eliminated in the case of the invention because the stator currents and the high-voltage can be transferred via the same high-voltage cable 94.

It may be shown that the direct current which flows from the capacitor 22 via the resistor 23 to the switching device 3 is a precise measure of the amplitude of the alternating currents flowing in the stator windings 13, 14 and 15, which in turn determine the driving torque acting on the rotor 12. Consequently, by stabilizing the direct current which flows to the switching device 3, the rotating anode drive can be stabilized from mains voltage fluctuations and with respect to fluctuations in the line resistances in the high-voltage cable or in the stator windings, which can occur, for example as a result of a change in temperature. The stabilization of the driving torque or of the stator currents simultaneously keeps the power loss to a minimum.

The regulating circuit required for stabilizing the direct current contains a pulse-duration modulator 36, which compares the voltage at the resistor 23, which is proportional to the direct current, with a predetermined value, and varies the duration of the switching pulses for the switch combinations 31 . . . 34 as a function thereof in such a way that the direct voltage at the resistor 23 corresponds to the predetermined value.

We claim:

1. A power generator for generating a first alternating current voltage applied to an X-ray tube anode and cathode to generate X-rays and a second alternating current voltage applied to a stator to rotate the anode via a rotor connected to the anode, said generator comprising:

an isolation transformer having primary and secondary windings;

means for applying a third alternating current voltage to said primary winding to produce an output voltage at said secondary winding;

rectifier means coupled to said secondary winding for rectifying the output voltage;

inverter means for receiving said rectified output voltage and for generating said second alternating current voltage from said received voltage;

a voltage generator for generating a fourth voltage and for applying said fourth voltage across said anode and cathode to generate said X-rays; and means for applying said fourth voltage to said inverter means and to said stator and for applying said second alternating current voltage to said stator.

2. The power generator according to claim 1 wherein the frequency of the third alternating current voltage that is applied to the primary winding is substantially higher than the frequency of the currents delivered by the inverter.

3. The power generator of claim 2 wherein said means for applying the third alternating current voltage includes a first switching device for generating alternating current voltage pulses from an applied direct current voltage.

4. The power generator of claim 3 wherein said inverter means includes a storage choke coupled between a second switching device and said rectifier means for generating said second voltage as a three phase signal.

5. The power generator of claim 3 wherein said means for applying said third voltage includes voltage regulating means for stabilizing said third voltage.

6. The power generator of claim 4 wherein said means for applying said third includes voltage regulating means for stabilizing the current of said third voltage.

7. The power generator of claim 5 wherein said regulating means includes resistance means connected between a terminal for receiving a direct current voltage and the first switching device for producing pulses from said received direct current voltage and a pulse duration modulator coupled to said resistance means that varies the duration of the pulses delivered by the switching device as a function of the direct voltage pulse duration at the resistance means.

8. The power generator of claim 6 wherein said regulating means includes resistance means connected between a terminal for receiving a direct current voltage and the first switching device for producing pulses from said received direct current voltage and a pulse duration modulator coupled to said resistance means that varies the duration of the pulses delivered by the switching device as a function of the direct voltage pulse duration att he resistance means.

9. The power generator of claim 4 wherein said inverter means includes a second transformer having primary and secondary windings and second rectifier means coupled to said isolation transformer secondary winding and to said second transformer primary winding, said second transformer primary winding forming said storage choke, a rectifier for coupling said second transformer secondary winding to a clock pulse generator for generating clock pulses and means for coupling said clock pulses to said second switching device.

10. The power generator of claim 1 including a multicore high voltage cable for jointly coupling the second voltage to said stator and the first voltage to the anode.

11. The power generator of claim 3 including a multicore high voltage cable for jointly coupling the second voltage to said stator and the first voltage to the anode.

12. The power generator of claim 4 including a multicore high voltage cable for jointly coupling the second voltage to said stator and the first voltage to the anode.

13. The power generator of claim 9 including a multicore high voltage cable for jointly coupling the second voltage to said stator and the first voltage to the anode.

* * * * *